US006253481B1

(12) United States Patent
Melby

(10) Patent No.: US 6,253,481 B1
(45) Date of Patent: Jul. 3, 2001

(54) SHOTGUN MOUNTABLE SHELL HOLDER

(75) Inventor: George R. Melby, 15534 NE. 96th St., Elk River, MN (US) 55330

(73) Assignee: George R. Melby, Elk River, MN (US)

( * ) Notice: Subject to any disclaimer, the term of this patent is extended or adjusted under 35 U.S.C. 154(b) by 0 days.

(21) Appl. No.: 09/306,264

(22) Filed: May 6, 1999

(51) Int. Cl.[7] ..... F41A 15/00

(52) U.S. Cl. ..... 42/90; 42/106; 244/191; 244/251; 244/931

(58) Field of Search ..... 42/90, 106, 88, 42/71.01; 89/34; 224/191, 251, 239, 931

(56) References Cited

U.S. PATENT DOCUMENTS

| | | | | |
|---|---|---|---|---|
| 3,744,170 | | 7/1973 | Jensen | 42/87 |
| 4,773,576 | | 9/1988 | Moravek | 224/191 |
| 4,860,478 | * | 8/1989 | Clayton | 42/71.01 |
| 4,953,316 | | 9/1990 | Litton, Sr. et al. | 42/90 |
| 5,054,221 | * | 10/1991 | Ozols | 42/17 |
| 5,813,157 | | 9/1998 | Scott et al. | 42/71.01 |

* cited by examiner

*Primary Examiner*—J. Woodrow Eldred
(74) *Attorney, Agent, or Firm*—Vidas, Arrett & Steinkrau

(57) ABSTRACT

The invention provides for a shotgun mountable shell holder which may be readily attached to the forearm of a shotgun. The present invention includes a first member having a forearm mounting region and a second member having a shell mounting region. The present invention is constructed so that when it is mounted to a shotgun it may hold an additional round of ammunition near the forehand of the shooter along the forearm or grip of the gun.

23 Claims, 1 Drawing Sheet

SHOTGUN MOUNTABLE SHELL HOLDER

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates to an auxiliary shell holder for use with a shotgun. Specifically, the present invention relates to a device for holding a shell in a convenient position adjacent to the shotgun forearm or grip. The position of the shell provides the user of the shotgun with the ability to readily grasp the shell and quickly load the shell into the gun.

It is well known that it is often desirable or necessary to have an extra shell available for rapid loading of a shotgun when the internal supply of ammunition within the gun has been depleted. Often a shooter may be firing at a moving target or a target which is otherwise difficult to hit. It may be necessary to fire at such a target several times. Regulations often limit the number of shells which may be loaded. Fumbling for a shell in a coat pocket or pouch may mean the loss of the shot at a fast moving target.

In an effort to provide a readily accessible ammunition supply to a shooter in the field, many devices exist which allow the user to carry numerous rounds of ammunition outside of the shotgun. For example, several different types of ammunition carrying belts, harnesses, straps, pouches, packs, and other personal storage devices exist which are well known in the art. Unfortunately, all of these devices have a common problem. They all are directed to carrying ammunition on the shooter's person.

In order to access ammunition from bodily carried storage containers, the shooter must take one or both of his or her hands away from his or her weapon in order to grasp the individual rounds and then bring his or her hands back to the weapon in order to chamber the round. While such action is not especially difficult, it results in a lowering of the shotgun and may take several critical seconds causing the shooter to lose sight of the target thus making the availability of additional rounds of ammunition mute.

U.S. Pat. No. 4,773,576 to Moravek avoids the necessity of bodily carried ammunition by providing a cartridge holder that may be mounted directly to a weapon. However, the Moravek cartridge holder utilizes an elastic band construction which may interfere with the functioning of many modem weapons, notably pump-action shotguns.

U.S. Pat. No. 5,813,157 to Scott et al provides for a shotgun stock that has been modified to include a compartment which is capable of holding extra shells within the confines of this stock compartment itself. Numerous devices exist which affix to a shotgun stock to provide a similar shell carrying capacity. Unfortunately, much like bodily carried ammunition holders, stock integral or stock mounted shell holders do not provide for a means of quickly grasping a shell while potentially maintaining the level and position of the shotgun.

The present invention overcomes the problems associated with bodily carried or stock mounted ammunition devices, as well as the shortcomings of the Moravek device, by providing an ammunition holder which may be readily attached to the forearm of a shotgun and hold an additional shell, conveniently positioned near the shooter's hand, along the forearm grip of the gun. By holding an additional round near the grip of the shotgun the shooter may load the additional round without having to lower the shotgun or take his or her hand(s) away from the gun. Thus, the present invention may be used to quickly supply an additional round to the shooter without reducing the readiness of the shotgun.

BRIEF SUMMARY OF THE INVENTION

The invention provides a shotgun mountable shell holder which may be readily attached to the forearm of a shotgun. The present invention is preferably embodied in an L-shaped structure which consists of a first member having a forearm mounting region and a second member having a shell mounting region. The present invention is constructed so that when it is mounted to a shotgun it may hold an additional shell near the forehand of the shooter along the forearm or grip of the gun.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

Many shotguns include a forearm that has an end portion which protrudes out of the forearm and extends toward the end of the shotgun barrel. Typically, such forearm end portions have a diameter less than that of the forearm itself, and are threaded to receive an end cap.

Figure 1:
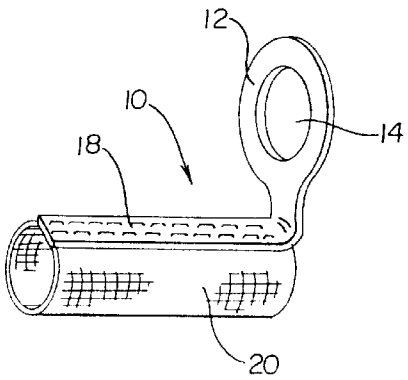
FIG. 1 is a side perspective of an embodiment of the shotgun mountable shell holder wherein the shell mounting region includes an elastic sleeve.

Turning to FIG. 1, the present shotgun mountable shell holder, shown generally at 10, includes a forearm mounting region 12 which may be embodied by a piece of molded polymer, metal or other solid material which has an opening or hole 14 that passes therethrough. In the embodiment shown in FIG. 1, the shotgun mountable shell holder 10 has a shell mounting region 18 which includes an elastic sleeve 20 that is capable of receiving a shell and retaining it therein. The elastic sleeve 20 may be attached to the shell mounting region 18 with an adhesive or may be mechanically attached by a variety of means, such as by heat bonding, welding, or sewing together the elastic sleeve 20 and shell mounting region 18 with a binding thread.

Figure 2:
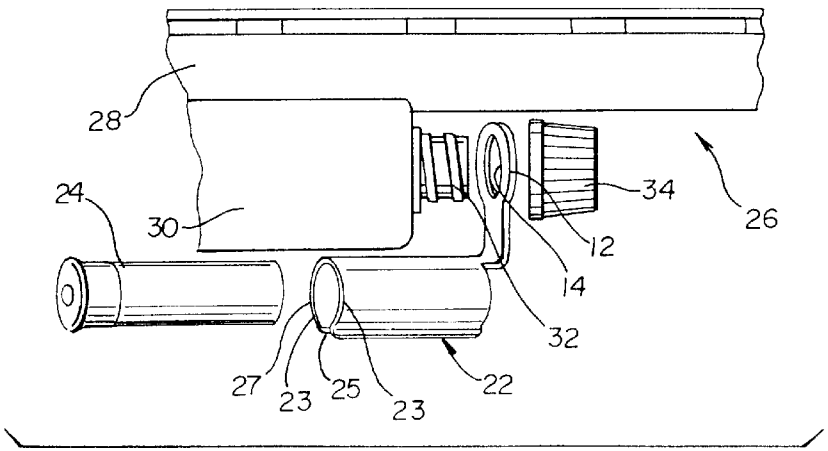
FIG. 2 is a side perspective showing the placement of an embodiment of the shotgun mountable shell holder wherein the shell mounting region includes a shell retaining clip, on the end of the forearm of a shotgun.

FIG. 2 shows a preferred embodiment of the shotgun mountable shell holder 10, wherein the shotgun mountable shell holder 10 is a single molded bracket and includes a shell retaining clip 22. Clip 22 has two sides 23 and an opening 25 therebetween. Opening 25 is constructed to frictionally engage a shell which is inserted between sides 23. A shell 24 may be 'clipped' into opening 25 from below the retaining clip 22. Alternatively, shell 24 may be slid into open end 27 of shell retaining clip 22. The shell may be subsequently 'unclipped' or slid out of the retaining clip 22 as shown. Desirably, the shell holder will be made of a resilient material. The embodiment of FIG. 2 may also be formed of a multi-piece construction. Desirably, the clip portion will be made of a resilient polymer or metal, such as steel, to allow the clip to expand slightly on insertion of the shell and to retain the shell therein.

Also shown in FIG. 2 is a partial side view of a shotgun, shown generally at 26. The partial shotgun depicted in FIG. 2 includes a barrel 28 and a forearm 30. The forearm 30 has an end portion 32 which is typically threaded to receive an end cap 34. When the end cap 34 is removed from the end portion 32, the end portion 32 may be inserted into opening 14. The end portion 32 has a diameter less than the diameter of the opening 14, thereby allowing the forearm mounting region 12 to be readily fitted over the end portion 32. The end cap 34, which has a diameter greater than that of the opening 14, may then be replaced so as to tightly secure the shotgun mountable shell holder between the forearm 30 and the end cap 34. When the shotgun mountable shell holder 10 is attached to a shotgun in the manner described, the shell mounting region 18 is adjacent to and parallel with the forearm 30 as best shown by FIG. 3.

Figure 3:
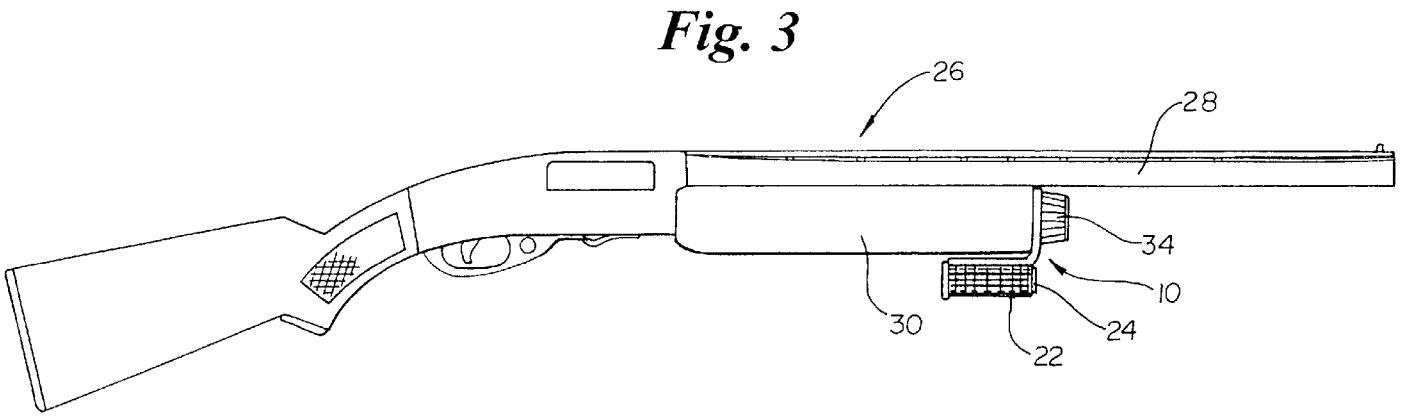
FIG. 3 is a side perspective of a shotgun with the shotgun mountable shell holder mounted to the end of the forearm.

FIG. 3, shows the shotgun mountable shell holder 10 mounted to a shotgun 26. As can be seen from this view, when properly attached to a shotgun, the present shotgun mountable shell holder 10 allows a shooter to have an auxiliary shell placed immediately adjacent to the forearm 30. When a shotgun is being fired, a shooter will typically have a forehand grip on the forearm 30, immediately behind the shotgun mountable shell holder 10. Having an additional shell in such close proximity allows the shooter to grasp the shell, remove it from the holder, and chamber the shell, in a quick fluid motion.

Furthermore, by adjusting the end cap 34, the present shotgun mountable shell holder 10 may be rotated around the end portion 32 to be repositioned around the forearm 30 depending on the individual preferences of the shooter. This feature increases efficiency even further by allowing individual shooters to position the shotgun mountable shell holder as desired.

It may be necessary with pump-action shotguns for the shell mounting region 18 to face toward the barrel 28 to avoid interference with the slide action of the forearm 30. In addition, the design of forearm mounting region 12 may differ according to the type of shotgun. Desirably, the forearm mounting region 12 cooperates with whatever form of end portion 32 construction may be present.

Finally, the invention also contemplates placing several shells in the holder, either by providing a clip long enough to accommodate two or more shells end-to-end or by adding additional separate clips.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A shotgun mountable shell holder comprising a bracket, the bracket comprising:

(a) a forearm mounting portion with a forearm opening therein, the forearm opening sized to removably receive an end portion of a forearm of a shotgun; and (b) a shell mounting portion, the shell mounting portion having a shell opening therein, the shell opening sized to removably receive a shell, the shell mounting portion extending from the forearm mounting portion.

2. The shotgun mountable shell holder of claim 1 further comprising a shell disposed in the shell mounting portion.

3. The shotgun mountable shell holder of claim 1 wherein the forearm mounting portion comprises a sheet of material, the forearm opening extending therethrough.

4. The shotgun mountable shell holder of claim 1 wherein the forearm mounting portion of the bracket is perpendicular to the shell mounting portion of the bracket.

5. The shotgun mountable shell holder of claim 1 wherein the shell mounting portion of the bracket is positioned parallel to the forearm of a shotgun when the shell holder is mounted on the shotgun, the end portion of the forearm extending through the forearm opening.

6. The shotgun mountable shell holder of claim 1 wherein the shell mounting portion further comprises a curved member, the curved member constructed and arranged to frictionally engage and removably retain a shell therein.

7. The shotgun mountable shell holder of claim 6 wherein the curved member is constructed to slidably receive and removably retain the shell.

8. The shotgun mountable shell holder of claim 6 wherein at least the shell mounting portion is constructed from steel.

9. The shotgun mountable shell holder of claim 1 wherein the shell mounting portion includes a cylindrical, elastic closed loop portion which is expandable to removably embrace one or more shells.

10. The shotgun mountable shell holder of claim 9 wherein the closed loop portion is adhesively bonded to the shell mounting member.

11. A shotgun mountable shell holder having an L-shaped attachment device comprising a bracket, the bracket having:

(a) a forearm mounting portion with a forearm opening therein, the forearm opening sized to receive at least an end portion of a forearm of a shotgun, and (b) a shell attachment member extending perpendicularly from the forearm mounting portion, the shell attachment member having a top surface and a bottom surface, the top surface of the shell attachment member being adjacent to the forearm of the shotgun when the forearm mounting portion is received by the at least an end portion of the forearm, the shell attachment member defining a shell opening, the shell opening sized to retain a shell.

12. In combination, a shotgun having a forearm with an end portion extending therefrom and a shell holder bracket, the shell holder bracket including:

(a) a forearm mounting portion, the forearm mounting portion being mounted to the end portion of the forearm of the shotgun; and (b) a shell mounting portion, the shell mounting portion having a shell opening therein, the shell opening sized to retain a shell.

13. The combination shotgun and shell holder of claim 12 further including a shell.

14. The combination shotgun and shell holder of claim 12 wherein the shell holder is removable from the end portion.

15. A shotgun having a forearm portion, the forearm portion having an end portion with a bracket extending from the end portion of the forearm portion of the shotgun, the bracket including a shell holder.

16. The shotgun of claim 15 wherein the bracket is constructed and arranged to hold a shell substantially parallel to the forearm portion of the shotgun.

17. The shotgun of claim 16 therein the bracket is removable from the forearm portion.

18. In combination, a shotgun mountable shell holder and a shotgun, the shotgun comprising a forearm with an end portion and a forearm end cap; the shotgun mountable shell holder comprising a bracket, the bracket having:

(a) a forearm mounting portion comprising a sheet of material with a forearm opening therein, the forearm opening sized to removably receive the end portion of the forearm of the shotgun; and (b) a shell mounting portion, the shell mounting portion having a shell opening therein, the shell opening sized to removably receive a shell, the shell mounting portion extending from the forearm mounting portion, wherein the end portion of the forearm is received in the forearm opening and the forearm end cap is removably secured to the end portion of the forearm, at least a portion of the forearm end cap having a diameter greater than that of the forearm opening.

19. A shotgun mountable shell holder comprising a bracket, the bracket having:

(a) a forearm mounting portion with a forearm opening therein, the forearm opening sized to removably receive an end portion of a forearm of a shotgun; and (b) a shell mounting portion extending from the forearm mounting portion, the shell mounting portion comprising a curved member, the curved member having two sides with a shell opening therebetween, the two sides being positioned and sized such that a shell may be clipped into the shell opening and removably retained therein with the curved member frictionally engaging the shell.

20. A shotgun mountable shell holder comprising a bracket, the bracket comprising:

(a) a forearm mounting portion with a forearm opening therein, the forearm opening sized to removably receive an end portion of a forearm of a shotgun; and (b) a shell mounting portion extending from the forearm mounting portion, the shell mounting portion comprising a curved member having a shell opening therein, the curved member and shell opening sized to removably receive and frictionally engage a shell therein, wherein at least the shell mounting portion is constructed from a molded polymer.

21. The shotgun mountable shell holder of claim 20 wherein the curved member is substantially tubular.

22. The shotgun mountable shell holder of claim 1 wherein the curved member is substantially tubular.

23. The shotgun mountable shell holder of claim 11 wherein the curved member is substantially tubular.

* * * * *